United States Patent [19]

Gruber et al.

[11] Patent Number: 4,457,998

[45] Date of Patent: Jul. 3, 1984

[54] COMPOSITION WITH UNCROSSLINKED POLYMER CONTAINED IN A CROSSLINKED POLYMER NETWORK

[75] Inventors: Robert J. Gruber, Pittsford; Steven Bolte, Rochester; Bernard Geushkin, Pittsford; Ronald J. Koch, Rochester, all of N.Y.

[73] Assignee: Xerox Corporation, Stamford, Conn.

[21] Appl. No.: 346,471

[22] Filed: Feb. 8, 1982

[51] Int. Cl.[3] ..... G03G 5/00; G03G 9/08; H05B 3/10; B05D 1/06

[52] U.S. Cl. ..... 430/98; 430/99; 430/109; 430/110; 430/124; 525/192

[58] Field of Search ..... 430/109, 99, 98, 110, 430/124; 525/192, 207, 903

[56] References Cited

U.S. PATENT DOCUMENTS

| | | | |
|---|---|---|---|
| 3,390,105 | 6/1968 | Verdol | 260/2.5 |
| 3,509,078 | 4/1970 | Roubinek et al. | 260/2.5 |
| 3,510,338 | 5/1970 | Varron | 117/17.5 |
| 3,698,314 | 10/1972 | Grier | 430/99 |
| 3,874,843 | 4/1975 | Fujimoto | 430/99 |
| 3,938,992 | 2/1976 | Jadwin et al. | 96/1 S D |
| 3,941,898 | 3/1976 | Matsu et al. | 430/109 |
| 3,948,215 | 4/1976 | Namiki | 430/99 |
| 3,988,061 | 10/1976 | Root | 430/98 |
| 4,217,406 | 8/1980 | Tanaka et al. | 430/137 |
| 4,246,332 | 1/1981 | Tanaka et al. | 430/109 |
| 4,298,672 | 11/1981 | Lu | 430/109 |
| 4,299,903 | 11/1981 | Auclair et al. | 430/109 |
| 4,314,017 | 2/1982 | Takahashi et al. | 430/109 |
| 4,320,714 | 3/1982 | Shimazaki et al. | 430/99 |
| 4,336,766 | 6/1982 | Maher et al. | 430/99 |
| 4,340,660 | 7/1982 | Kiuchi et al. | 430/109 |

FOREIGN PATENT DOCUMENTS

| | | | |
|---|---|---|---|
| 2081280 | 2/1982 | United Kingdom | 430/109 |

*Primary Examiner*—Edward C. Kimlin
*Assistant Examiner*—Merrell C. Cashion
*Attorney, Agent, or Firm*—E. O. Palazzo

[57] ABSTRACT

This invention is directed to improved developer compositions comprised of resin particles, pigment particles, and carrier particles, the improvement residing in the resin particles which are comprised of an uncrosslinked polymer incorporated into a polymer network highly crosslinked in the presence of the uncrosslinked polymer, the uncrosslinked polymer being of a different chemical composition than the crosslinked polymer, thereby resulting in the formation of a sponge-like structure; which developer compositions are useful in electrostatographic imaging systems, including those devices employing cold pressure fixing apparatus.

18 Claims, No Drawings

COMPOSITION WITH UNCROSSLINKED POLYMER CONTAINED IN A CROSSLINKED POLYMER NETWORK

BACKGROUND OF THE INVENTION

This invention is generally directed to toner and developer compositions as well as the use of such compositions in various imaging systems. More specifically, the present invention is directed to toner materials containing interpenetrating polymer networks comprised of uncrosslinked polymers, incorporated into a polymer network of highly crosslinked polymers, and developer compositions containing such polymers. Toners containing such polymers have several improved characteristics, over many prior art toners including reduced gloss, improved blocking performance, superior offsetting characteristics, improved release properties, and the like. Accordingly, such toner compositions depending on the selection of the crosslinked and uncrosslinked polymers are useful in numerous types of imaging systems, including hot roll pressure fusing systems, cold pressure fusing systems, and the like, as more specifically detailed hereinafter.

The electrostatographic process, and more specifically the xerographic process is well known as documented in several prior art references. In these processes, an electrostatic latent image is developed by applying toner particles to the image, using for example cascade development magnetic brush development, or touchdown development. In some instances it may be desirable in such systems to produce a reverse copy of the original. Thus, for example, it may be desirable to produce a negative copy from a positive original, or a positive copy from a negative original, which is accomplished by modifying the triboelectric charging properties of the toner and carrier particles.

Toner particles utilized to develop latent images are usually present in a developing composition containing carrier particles, such as triboelectrically chargeable non-magnetic materials, or triboelectrically chargeable magnetic materials; the toner particles being electrostatically attractable to the carrier particles. The toner particles generally are comprised of a toner resin, and colorants or pigments such as carbon black. Subsequent to development, the image is transferred to a permanent substrate such as paper, and fixed thereto by a number of known methods including heat fusing, cold pressure fix fusing, and the like. Accordingly, the toner particles must possess properties so as to enable them to be properly fused without causing deterioration thereof, and thus adversely affecting the quality of the resulting images. Also, toner compositions that might be useful in heat fusing systems, are generally not useful with cold pressure fixing devices.

Furthermore, many of the prior art toner compositions utilized for developing electrostatic latent images transfer from the developed toner image present on the permanent substrate to the surface of the fusing members, particularly the heated fusing members. Such an undesirable transfer of toner particles not only disrupts the quality of subsequent images, but also contaminates the surface of the fusing member, causing the contaminated toner particles to be transferred to succeeding substrates or copying sheets when the fusing member is used in subsequent imaging cycles. In such instances, undesirable deposits of toner material are then formed in background areas, resulting in copies of low quality.

There is described in U.S. Pat. Nos. 4,217,406 and 3,938,992 crosslinked toner resins which are stated as overcoming some of the prior art problems associated with previous toner resins. For example, in U.S. Pat. No. 3,938,992 there is described improved developing compositions containing finely divided carrier particles, and finely divided crosslinked toner particles containing a fusible binder polymer, with the molecular chains of said binder polymer being crosslinked to an extent sufficient to extend the useful fusing range of the crosslinked toner particles by at least 10° C., relative to comparable uncrosslinked toner particles comprising an identical binder polymer, with the exception that the molecular chains thereof are uncrosslinked, as are conventional toner binder polymers. More specifically, it is stated in this patent that the preferred styrene containing binder polymers are crosslinked to an extent sufficient to provide a useful fusing range of at least about 90° C., and to extend the useful fusing range of the toner particles by at least about 20° C. relative to comparable uncrosslinked toner particles comprising the same styrene containing polymer, except in an uncrosslinked form. Developing compositions containing such toners according to the teachings of this patent apparently substantially eliminate the transfer of undesirable toner particles to the fusing member referred to therein as "off-setting."

According to the disclosure of the '992 patent, the toner composition involved distinguishes over the toner composition described in U.S. Pat. No.3,804,764, in that the '764 toner is concerned primarily with the use of weakly crosslinked toners to provide a pressure fixable toner. In contrast, the crosslinked resins of the '992 patent contain linkages of sufficient strength so as to retain the crosslinks, thus, the crosslinks are not disrupted nor broken during fixing. Thus, it is the presence of these crosslinks in the toner polymer which during fixing provides the desired increase in useful fusing range. In the '764 patent, there is disclosed polymers that have weak crosslinks, which when used in an imaging system convert to an uncrosslinked state and then revert back to a weakly crosslinked state. Useful fusing range is defined in this patent as the difference in temperature between the minimum adequate fusing temperature and hot offset temperature. It is important to note that these patents teach the use of resins containing very low levels of crosslinking and further only a single main polymer and a crosslinking agent are employed. Additionally, there is no teaching in these patents as to the utilization of such toner resins in a number of different imaging systems, including hot roll fixing systems and cold pressure roll fusing devices, nor is there any teaching as to the employment of two polymers, one polymer contained in another polymer, one of which is highly crosslinked, the polymers being of different compositions.

Further, none of these patents disclose the cross-linking of one polymer in the presence of another polymer, as with the interpenetrating polymers of the present invention, nor do these patents disclose the importance of maintaining such polymers at the gel point or above. Thus, in the homogeneous systems described in the above-mentioned patents, partial crosslinking results in a very even or uniform structure, rather than, as in the present invention, the formation of small discontinuous domains of uncrosslinked polymer in a crosslinked polymer, similar to a sponge structure. Such a sponge-like toner composition imparts improved characteristics to toner compositions, enabling, for example, lower fusing temperatures, and superior fixing of the resulting image.

There thus continues to be a need for improved developing compositions, particularly improved oiless toner compositions which compositions can be used in a variety of different imaging devices, including devices employing hot roll fusing, cold pressure fixing, and the like. There also continues to be a need for improved toner compositions which are simple to reproduceably manufacture; and which compositions when used for developing images have improved offsetting characteristics, improved blocking performance, reduced gloss, and the like.

SUMMARY OF THE INVENTION

It is a feature of the present invention to provide a toner composition, and a developing composition containing same, which overcomes the above-noted disadvantages.

A further feature of the present invention is the provision of a toner composition comprised of two or more different polymers, one of the polymers being highly crosslinked.

Another feature of the present invention is the provision of a toner composition comprised of uncrosslinked polymers incorporated into a polymer network of crosslinked polymers, so as to form a sponge like structure, each of the polymers having a different chemical composition.

Yet another feature of the present invention is the provision of a toner composition which can be utilized in various imaging systems depending on the selection of the uncrosslinked polymers incorporated into the polymer network of the crosslinked polymer.

An additional feature of the present invention is the provision of improved toner compositions which have low fusing temperature characteristics, superior offsetting properties, improved blocking performance, reduced gloss, and improved release properties.

Yet another feature of the present invention is the provision of toner compositions which are useful in cold pressure fix systems.

These and other features of the present invention are accomplished by providing an improved developing composition comprised of toner particles and carrier particles, the improvement residing in the toner particles comprised of pigment particles and an uncrosslinked polymer incorporated into a polymer network which has been highly crosslinked in the presence of the uncrosslinked polymer, the uncrosslinked polymer being of a different chemical composition than the crosslinked polymer. The resulting composition is sponge-like in appearance, and sufficient crosslinking has been accomplished so as to result in the formation of a gel, greater than about 3 percent of crosslinking.

The uncrosslinked polymer can be selected from various suitable polymers including styrene/alkylacrylate polymers, such as poly(styrene-co-n-butyl methacrylate) polymers, styrene butadiene polymers, such as poly(styrene-co-butadiene) polymers, polyethers, polyesters, polyamides, co-polycarbonates, and the like. The crosslinked polymer can be selected from other similar polymers, including polymeric anhydrides, such as a poly(octadecene-co-maleic anhydride) polymer, a poly(styrene-co-maleic anhydride) materials; epoxies, poly(styrene-co-hydroxy propylmethacrylate), poly(styrene-co-allyl alcohol) polymers, and the like. Other useful crosslinked and uncrosslinked polymers are described in the working examples hereinafter.

The appropriate polymer is crosslinked in the presence of the uncrosslinked polymer, the objective of the crosslinking being to form a semi-rigid, porous structure, or interpenetrating polymer network, similar to a sponge. Thus, it is believed that the uncrosslinked polymer is contained in the polymer network of the crosslinked polymer, and occupies the voids of the semi-rigid porous crosslinked polymer. In one embodiment, on fusing under pressure, for example, the uncrosslinked polymer discharges from the voids into the paper fibers, thereby forming a bond between the toner particles and the paper surface. The primary purpose of the crosslinked polymer is to function as a carrier for the uncrosslinked polymer.

The uncrosslinked polymers, and crosslinked polymers of the present invention are present in the final composition in a sufficient amount so as to achieve the desired objectives indicated herein. Generally, the uncrosslinked polymer is present in an amount ranging from about 10 weight percent to about 90 weight percent, and the crosslinked polymer is present in an amount ranging from about 90 weight percent to about 10 weight percent.

Crosslinking of the polymer involved is accomplished by known methods in the presence of a crosslinking agent such as phenylenediamine, octadecene maleic anhydride copolymer, divinylbenzene, polyfunctional alcohols, isocyanates, amines, and the like. In one illustrative embodiment, the process for preparing the sponge-like interpenetrating polymer network system of the present invention is accomplished by mixing a polystyrene/n-butylmethacrylate-maleic anhydride terpolymer, containing 60 percent by weight of styrene, 30 percent by weight of n-butylmethacrylate, and 10 percent by weight of maleic anydride, with a polystyrene n/butylmethacrylate copolymer, containing 65 percent by weight of styrene, and 35 percent by weight of n-butylmethacrylate, such mixing being accomplished in the presence of a diol, such as 1,6-hexanediol, and carbon black. The mixing is effected at a temperature of from about 325° F. to 350° F. for a period of 30 minutes, after which the terpolymer has been crosslinked with the 1,6-hexanediol. Subsequent to cooling to room temperature, there results an interpenetrating polymer material as described herein having a particle size of about 10 to 15 microns subsequent to mechanical attrition.

By highly crosslinked is meant that the polymer involved is substantially crosslinked, that is, equal to or above its gel point. It is critical to the present invention that the crosslinked polymer be at or above its gel point (point where the polymer is no longer soluble in solution) since if this is not the situation, there will result a less desirable toner composition possessing higher gloss characteristics, and increased offsetting properties.

Various suitable pigments or dyes may be employed as the colorant for the toner particles such materials being well known and including for example carbon black, iron oxides, nigrosine dye, and the like. The pigment or dye should be present in the toner in sufficient quantity to render it highly colored so that it will form a clearly visible image on the recording member. For example, where conventional xerographic copies of documents are desired, the toner may comprise a black pigment, such as carbon black. Preferably the pigment is employed in amounts of from about 3 percent to about 50 percent by weight based on the total weight of the toner particles, however, if the pigment employed is a dye substantially smaller quantities, for example less than 10 percent by weight, may be used.

Additionally, the toner particles of the present invention can contain magnetic pigments such as magnetites, and preferably the magnetite commercially available as Mapico black, in concentrations ranging from about 10 percent by weight to about 70 percent by weight. Also, the toner compositions of the present invention can contain charge control additives for the purpose of imparting a positive charge to the toner particles, such additives including alkyl pyridinium halides, such as cetyl pyridinium chloride, and known quaternary ammonium materials. These charge controls additives, and in particular the alkyl pyridinium halides are present in an amount of from about 0.1 weight percent to about 10 weight percent, based on the weight of toner particles.

Illustrative examples of suitable carrier particles that can be employed in formulating the developer composition of the present invention (toner plus carrier) include those carrier materials that are capable of triboelectrically obtaining a charge of opposite polarity to that of the toner particles such as steel, nickel, iron ferrites, silicon dioxide, and the like with metallic carriers, especially magnetic carriers being preferred. The carriers can be used with or without a coating, the coating generally containing polyvinylfluoride resins, terpolymers of methyl methacrylate, styrene, and silane, and the like. The diameter of the carrier particles ranges from about 25 microns to about 1,000 microns thus allowing the carrier to possess sufficient density and inertia to avoid adherence to the electrostatic latent image during the development process.

The carrier may be employed with the toner composition in various suitable combinations, however, best results are obtained when about 1 part to 3 parts of toner is used to about 10 to about 200 parts by weight of carrier.

The composition of the present invention may be used for obtaining various types of toners including oilless toners, cold pressure fix toners having low gloss and improved smear resistance, and toners exhibiting low gloss or a matte finish on fusing with a hard heat pressure roll fuser. Thus, examples of the different types of toners embraced with the present invention include:

(1) Oilless toners
(2) Cold pressure fix toners
(3) Toners exhibiting low gloss or a matte finish By oilless toners is meant toner compositions possessing suitable characteristics so as to enable their use in hot pressure roll fusing systems having no external release fluids applied either to the fuser roll or to the pressure roll surface.

The developer compositions of the present invention may be used to develop magnetic images, or electrostatic latent images in the aforementioned imaging systems, wherein there is utilized various photoreceptor devices including selenium, selenium arsenic alloys, selenium tellurium alloys, organic photoreceptors such as polyvinylcarbazole, phthalocyanines, layered organic photoresponsive devices containing generating and transport layers, including for example, an overcoated photoreceptor device comprised of a substrate, overcoating with a photogenerating layer, such as trigonal selenium, or vanadyl phthalocyanine, which in turn is overcoated with a transport layer. Other overcoated photoresponsive devices useful in the present invention include those comprised of a substrate, overcoated with a hole injecting layer, in contact with a charge transport layer, which is overcoated with a photogenerating layer which in turn is overcoated with an insulating organic resin. Examples of layered photoresponsive devices embraced within the present invention include those described in U.S. Pat. Nos. 4,265,990 and 4,251,612, the disclosure of each patent being totally incorporated herein by reference.

The following examples are being supplied to further define the species of the present invention, it being noted that these examples are intended to illustrate and not limit the scope of the present invention. Parts and percentages are by weight unless otherwise indicated.

EXAMPLE I

There was prepared by melt blending followed by mechanical attrition a toner composition comprised of 20.9 parts of a poly(styrene-co-n-butylmethacrylate) polymer, containing 65 percent styrene and 35 percent n-butylmethacrylate, 35.3 parts by weight of a poly(styrene-co-maleic anhydride) polymer, commercially available from Arco Chemical Corporation, as SMA 3000, 0.6 parts by weight of the crosslinking agent m-phenylenediamine, and 3.6 parts by weight of Regal 330 carbon black. The crosslinking reaction was accomplished at a temperature of 350° F. resulting in the SMA polymer being highly crosslinked, as evidenced by the formation of a gel. Also, TEM (Transmission Electron Microscopy) photographs revealed a sponge like system with voids of uncrosslinked polymer incorporated in the crosslinked polymer.

EXAMPLE II

A toner composition was prepared in accordance with Example I with the exception that there was used 19.6 parts of the poly(styrene-co-n-butylmethacrylate) polymer, 39.6 parts of the poly(styrene-co-maleic anhydride) polymer, 1.8 parts of 1,6-hexane diol as the crosslinking agent and 3.7 parts of Regal 330 carbon black.

There resulted a highly crosslinked polymer comprised of the SMA 3000 material having incorporated therein the uncrosslinked polymer poly(styrene-n-butyl methacrylate) polymer as evidenced by the formation of a gel. Also TEM photographs revealed a sponge like structure with voids of the uncrosslinked polymer incorporated in the crosslinked polymer.

The above-prepared toner composition when placed in hot toluene (above room temperature) resulted in a gel which would not dissolve. Removing the gelled fraction from the composition resulted in a poly(styrene-co-n-butylmethacrylate) polymer and carbon black composition. In contrast, prior to crosslinking, all of the toner polymer or resin dissolved.

EXAMPLE III

A toner composition was prepared in accordance with Example I with the exception that 17.2 parts of poly(styrene-co-butadiene) polymer were utilized containing 90 percent styrene and 10 percent butadiene by weight, 28.7 parts by weight of a poly(styrene-co-allyl alcohol) crosslinking polymer, 11.5 parts of poly(1-octadecene-co-maleic anhydride) polymer as a crosslinking agent, 1.2 grams of polypropylene wax and 3.7 parts of Regal 330 carbon black.

EXAMPLE IV

The procedure of Example I was repeated, with the exception that poly(1,3-butylene terephthalate) (I) and poly(1,3-butylene terephthalate-co-fumarate) (II) (terephthalate/fumarate ratio 10:1) were blended in a Brabender-plastograph at 180° C. in the presence of carbon black and the peroxide catalyst Luperco 130XL, 45 percent 2,5-dimethyl-2,5-bis(t-butylperoxy)-hexyne-3 in an inert filler, and 1.2 parts of polypropylene wax. The ratio of I to II was 1:1. The melt viscosity increased, and after 15 minutes the blend was removed from the plastograph, cooled, crushed and converted to toner particles.

EXAMPLE V

There was prepared in accordance with Example IV, a toner composition comprised of 55.2 parts of a branched polymer poly(1,3-butylene-terephthalate-pentaerythritol), 36 parts of the product formed from the reaction of 2,2-bis(4-hydroxy-isopropoxy-phenyl) propane and fumaric acid, 0.8 parts by weight of the crosslinking agent Mondur M, a di-isocyanate commercially available from Mobay Chemical, 2.0 parts of polypropylene wax, and 0.2 parts of Regal 330 carbon black.

EXAMPLE VI

Developer compositions were prepared by mixing 1 part of the toner compositions of Examples I, II and III, IV, and V with 50 parts by weight of a carrier comprised of a steel core coated with a polyvinylidene fluoride resin. These developer compositions were used to develop electrostatic images utilizing a Xerox 9200 fuser assembly device and there was obtained in each instance excellent quality images with reduced gloss, when compared to lower quality images of high gloss with identical toner compositions that had not been crosslinked. Also, excellent release characteristics are observed for the above developer compositions with the toners of Examples III and IV without utilizing a release agent on the fuser roll as is customarily practiced in most commercial imaging devices.

A crosslinked polymer having incorporated therein an uncrosslinked polymer was evidenced by the formation of a gel and TEM photographs which revealed a sponge like system with voids of uncrosslinked polymer incorporated into the crosslinked polymer.

The reduction in gloss for the crosslinked developer compositions were believed to be obtained primarily as a result of a decrease in the flowability of the toner particles, as well as the coalescense of the toner particles. Further the crosslinked polymers in the developer compositions can be observed utilizing a microscope, such particles providing an irregular surface in the interpenetrating polymer network, this surface causing a scattering of reflective light, and resulting in a matte finish.

EXAMPLE VII

There was prepared a cold pressure fix toner exhibiting reduced gloss and improved smear, as compared to a cold pressure fix toner which has not been crosslinked, in accordance with the procedure of Example I, with the exception that there was employed 13.8 parts of poly(ethylene-co-vinylacetate) polymer, 3.7 parts of poly(1-octadecene-co-maleic anhydride), 6.6 parts of poly(styrene-co-allyl alcohol) polymer, 6.6 parts of poly(styrene-co-butadiene) polymer, and 4.4 parts of Regal 330 carbon black.

The above toner composition was mixed with a carrier comprised of a steel core continuing a coating of a terpolymer of styrene, butyl methacrylate, and silane, and this developer composition was employed for developing images in a Xerox Model D imaging device using a roll fuser at a pressure of 400 pounds per linear inch and moving at a speed of 5 inches per second. The resulting fused images have improved toner smear resistance as evidenced by Taber abraser measurements, and low gloss as evidenced, by reflective measurements, in comparison to prior art cold pressure fix toners comprised of the identical toner composition with the exception that no crosslinking was accomplished. Similar desirable results were obtained when comparing the gloss and smear resistance of the crosslinked toner composition of this Example as compared to a toner composition that is prepared by physically blending the identical polymers of Example VII.

EXAMPLE VIII

As an alternative to the procedure of Example VII, a linear polymer can be dissolved in the monomer and the crosslinking agent, followed by polymerization either in bulk or via suspension polymerization. Suspension polymerization was accomplished by mixing 166.8 parts of styrene, 33.2 parts by weight of stearyl methacrylate, 4.0 parts of divinylbenzene, 4.2 parts of benzoyl peroxide, and 80 parts of poly(octadecylvinyl ether-co-maleic anhydride) polymer. The resulting solution is then added to 929 millimeters of water, 10 parts by weight of tricalcium phosphate, and 0.16 parts by weight of the surfactant Alkanol, XC commercially available. The mixture is polymerized at 90° C., and the resulting polymer was blended with 8 parts of Regal 330 carbon black.

The toner was then mixed with carrier particles consisting of a steel core coated with the terpolymer of Example VIII, and the developing composition was employed to develop images in the Xerox Model D imaging device of Example VII, on plain paper commercially available from Xerox Corporation, as 4024 paper. The developed image is pressure fixed using a 3 inch roll fuser assembly with a pressure of 400 pounds per linear inch. The resulting image exhibited smear resistance and is of low gloss.

The following Table illustrates some of the properties of the interpenetrating polymers of the present invention as compared with other compositions.

| | Interpenetrating Network Polymers Fusing Characteristics | | | | |
|---|---|---|---|---|---|
| Crosslinked (Network polymer) | Uncrosslinked Material | Crosslinking Agent | Wax | Release[1] Characteristic | Gloss[2] Level % Reflectance |
| (1) None | Styrene- | None | Polypro- | Poor | High |

-continued

| Crosslinked (Network polymer) | Interpenetrating Network Polymers Fusing Characteristics: Uncrosslinked Material | Crosslinking Agent | Wax | Release[1] Characteristic | Gloss[2] Level % Reflectance |
|---|---|---|---|---|---|
| | n-butyl acrylate copolymer (65:35) | | pylene | | |
| (2) Styrene-n-butyl methacrylate-maleic anhydride terpolymer (55:35:10) | Styrene-n-butyl methacrylate copolymer (65:35) | 1,6-Hexane diol | Polypropylene | Excellent | Low |
| (3) Styrene-n-butyl methacrylate-maleic anhydride terpolymer (55:35:10) | Styrene-n-butyl methacrylate copolymer (65:35) | None | Polypropylene | Fair | High |
| (4) Styrene-n-butyl methacrylate-maleic anhydride terpolymer (55:35:10) | Styrene-n-butyl methacrylate copolymer (65:35) | 1,6 Hexane diol | None | Very poor | Very low |
| (4) Styrene-maleic anhydride polymer (SMA 3000 ARCO CHEM) | Styrene-n-butyl methacrylate copolymer (65:35) | 1,6 Hexane diol | Bareco Wax 2000 | Excellent | Very low |
| (5) Styrene-maleic anhydride polymer (SMA 3000 ARCO CHEM) | Styrene-n-butyl methacrylate copolymer(65:35) | 1,6 Hexane diamine | Bareco Wax 2000 | Excellent | Very low |
| (6) Styrene maleic anhydride copolymer (SMA 3000 ARCO CHEM) | Styrene-n-butyl methacrylate 65:35 | pentaerythritol | polypropylene | Excellent | Very low |
| (7) Poly(1,3-butylene terephthalate-pentaerythritol terpolymer | Condensation product of 2,2-bis (4-hydroxyphenyl) propane & fumaric acid mol wt. 4000 | Diphenylmethane diisocyanate | Bareco wax 2000 | Excellent | Low |
| (8) Styrene-n-butyl methacrylate-maleic anhydride terpolymer (55:35:10) | Styrene-butadiene(89:11) | 1,6 Hexane diol | polypropylene | Excellent | Med. |
| (9) Polyamide (Emerez 1565) | Condensation product of 2,2 diisocy-bis(4-hydroxy isopropoxyphenyl) propane & fumaric acid mol wt. 4000 | Diphenylmethane cyanate | Polypropylene | Excellent | Low |
| (10) EPON 1002 | EPON 1010[3] | 1,6 hexane | Polypropylene | Excellent | Low |

-continued

| Crosslinked (Network polymer) | Interpenetrating Network Polymers Fusing Characteristics: Uncrosslinked Material | Crosslinking Agent | Wax | Release[1] Characteristic | Gloss[2] Level % Reflectance |
|---|---|---|---|---|---|
| | | diamine | | | |

[1]Xerox 9200 fuser assembly which was operated without any silicone release fluid.
[2]Gloss level was determined using a photovolt device Model 670. Level of percent reflectance, high greater than 20%, med. 15-19, low 9-15, and very low 0-8.
[3]Epoxide end groups were ring opened, eliminating crosslinking.

As disclosed, other additives can be incorporated into the composition of the present invention, including waxes such as polypropylene, and the like. Generally such additives are present in small amounts, less than about 1 percent to up to about 10 percent.

Other modifications of the present invention may occur to those skilled in the art upon a reading of the present disclosure. These are intended to be included within the scope of the present invention.

We claim:

1. An improved developer composition comprised of resin particles, pigment particles, and carrier particles, wherein the resin particles are comprised of from about 10 percent by weight to about 90 percent by weight of an uncrosslinked polymer selected from styrene/alkylacrylate polymers, styrene butadiene polymers, polyethers, polyesters, polyamides, and copolycarbonates, which uncrosslinked polymer is contained in a highly crosslinked polymer network which highly crosslinked polymer network has been crosslinked in the presence of the uncrosslinked polymer, the crosslinked polymer network being selected from polymeric anhydrides, epoxies, poly(styrene-co-hydroxy proply methacrylate), and poly(styrene-co-allyl alcohol) polymers.

2. An improved developer composition in accordance with claim 1 wherein as the uncrosslinked polymner there is present about 20 percent by weight of a poly(styrene-co-n-butyl methacrylate) polymer, and as the crosslinked polymer there is present about 35 percent by weigh of a poly(styrene-co-maleic anhydride) polymer.

3. An improved toner composition in accordance with claim 1 wherein as the uncrosslinked polymer there is present about 17 percent by weight of a poly(styrene-co-butadiene) polymer, and as the crosslinked polymer there is present about 28 percent of a poly(styrene-co-allyl alcohol.

4. A developer composition in accordance with claim 1 wherein the uncrosslinked polymers are selected from poly(styrene-co-alkyl acrylate) polymers, poly(styrene-co-butadiene) polymers, polyether resins, polyesters, and co-polycarbonates, and the crosslinked polymer is selected from polymeric anhydrides, epoxies, styrene polymers, polyesters, and polyamides.

5. A developer composition in accordance with claim 4 wherein the poly(styrene-co-alkyl acrylate) polymers are poly(styrene-co-n-butyl methacrylate) polymers, the polymeric anhydrides are poly(octadecene-co-maleic anhydride) polymers, poly(styrene-co-maleic anhydride) polymers, and poly(styrene-co-hydroxypropyl methacrylate) polymers.

6. A developer composition in accordance with claim 1 wherein the carrier particles are comprised of a steel core coated with a polyvinylidene fluoride.

7. A developer composition in accordance with claim 1 wherein there is added thereto a charge enhancing additive for the purpose of imparting a positive charge to the toner resin, and a wax.

8. A developer composition in accordance with claim 7 wherein the charge enhancing additive is cetylpyridinium chloride.

9. A developer composition comprised of resin particles and magnetic particles, the resin particles being comprised of an uncrosslinked polymer contained in a highly crosslinked polymer network which highly crosslinked polymer network has been crosslinked in the presence of the uncrosslinked polymer, the uncrosslinked polymer being of a different chemical composition than the crosslinked polymer, thereby resulting in the formation of a sponge-like gel, said magnetic particles being present in an amount of from about 10 percent to about 70 percent by weight.

10. A method for developing images in electrostatographic imaging systems, which comprises forming an electrostatic latent image on an imaging member, contacting the image with the developer composition of claim 1, followed by transferring the image to a suitable substrate, and affixing thereto.

11. A method in accordance with claim 10 wherein the uncrosslinked polymers are selected from poly(styrene-co-alkyl acrylate) polymers, poly(styrene-co-butadiene) polymers, polyether resins, polyesters, and co-polycarbonates, and the crosslinked polymer is selected from polymeric anhydrides, epoxies, polyamides and polystyrene polymers.

12. A method in accordance with claim 11 wherein the styrene alkyl acrylate copolymers are poly(styrene-co-n-butyl methacrylate) polymers, the polymeric anhydrides are poly(octadecene-co-maleic anhydride) polymers, poly(styrene-co-maleic anhydride) polymers, and poly(styrene-co-hydroxypropyl methacrylate) copolymers.

13. A method in accordance with claim 10 wherein the carrier is comprised of a core coated with a polyvinylidene fluoride.

14. A method in accordance with claim 10 wherein fixing is accomplished by heat.

15. A method in accordance with claim 10 wherein fixing is accomplished by pressure in the absence of heat.

16. A method in accordance with claim 10 wherein fixing is accomplished in the absence of a release fluid.

17. A method in accordance with claim 9 wherein there is added to the developer composition a wax.

18. A method in accordance with claim 17 wherein the wax is polypropylene.

* * * * *

UNITED STATES PATENT AND TRADEMARK OFFICE

CERTIFICATE OF CORRECTION

PATENT NO. : 4,457,998

DATED : July 3, 1984

INVENTOR(S) : Robert J. Gruber, Steven B. Bolte, Bernard Grushkin, Robert J. Koch It is certified that error appears in the above-identified patent and that said Letters Patent are hereby corrected as shown below:

Title page, Item [75]

Inventor's name should be --Bernard Grushkin--.

Signed and Sealed this

Fourteenth Day of May 1985

[SEAL]

*Attest:*

DONALD J. QUIGG

*Attesting Officer* *Acting Commissioner of Patents and Trademarks*